US011731847B1

(12) United States Patent
Lei et al.

(10) Patent No.: US 11,731,847 B1
(45) Date of Patent: Aug. 22, 2023

(54) CUTTING PLOTTER

(71) Applicant: Shenzhen Aiduoduo Technology Co., Ltd., Shenzhen (CN)

(72) Inventors: Qian Lei, Shenzhen (CN); Wanchun Lei, Shenzhen (CN); Hexin Liu, Shenzhen (CN)

(73) Assignee: SHENZHEN AIDUODUO TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 18/167,904

(22) Filed: Feb. 13, 2023

(30) Foreign Application Priority Data

Dec. 9, 2022 (CN) ..... 202211578200.6

(51) Int. Cl.

| | |
|---|---|
| ***B65H 5/00*** | (2006.01) |
| ***B65H 5/02*** | (2006.01) |
| ***B26D 7/01*** | (2006.01) |
| ***B65H 35/00*** | (2006.01) |
| ***B26F 1/38*** | (2006.01) |

(52) U.S. Cl.
CPC ..... *B65H 5/021* (2013.01); *B26D 7/015* (2013.01); *B26F 1/3813* (2013.01); *B65H 35/002* (2013.01); *B65H 35/0086* (2013.01); *B65H 2301/51512* (2013.01)

(58) Field of Classification Search
CPC .. B65H 5/021; B65H 35/002; B65H 35/0086; B65H 2301/51512; B26D 7/015
USPC ..... 83/614
See application file for complete search history.

(56) References Cited

U.S. PATENT DOCUMENTS

| | | | | |
|---|---|---|---|---|
| 3,600,998 | A * | 8/1971 | Palmer | B26D 7/015 83/628 |
| 3,958,477 | A * | 5/1976 | Carlson | B26D 1/20 83/485 |
| 5,954,439 | A * | 9/1999 | Brannan | B41J 11/706 400/621 |
| 6,092,450 | A * | 7/2000 | Dueck | B65H 35/08 83/508 |
| 6,302,602 | B1 * | 10/2001 | Kiyohara | B41J 11/706 400/621 |
| 6,520,701 | B2 * | 2/2003 | Kaya | B41J 11/70 400/621 |
| 6,732,620 | B1 * | 5/2004 | Brodmann | B26D 1/185 83/489 |

(Continued)

*Primary Examiner* — Omar Flores Sanchez
(74) *Attorney, Agent, or Firm* — Andrew C. Cheng

(57) ABSTRACT

A cutting plotter includes a cutting plotter shell, a placement plate disposed outside the cutting plotter shell, an upper transmission assembly and a lower transmission assembly disposed at two ends of the cutting plotter shell, and a belt assembly disposed in the cutting plotter. The lower transmission assembly and the upper transmission assembly correspond to each other to assist paper in entering the cutting plotter. A slide rod is disposed in the cutting plotter shell and located at the top of the upper transmission assembly, and a cutting tool assembly is disposed on the slide rod. The belt assembly includes a driving motor. A belt body is steered through a steering belt wheel of the belt assembly, and the distance between parallel parts of the belt body is decreased through two small-radius tensioning belt wheels, such that the chain installation space is reduced and the cutting plotter is compact.

10 Claims, 7 Drawing Sheets

(56) References Cited

U.S. PATENT DOCUMENTS 6,782,784 B2 * 8/2004 Sato ..... B41J 11/706 83/485
9,238,566 B2 * 1/2016 Ogawa ..... B26D 7/2621
11,446,940 B2 * 9/2022 Gistas Perez ..... B26D 1/065
2005/0011322 A1 * 1/2005 Trovinger ..... B26D 11/00 83/404.1
2005/0061127 A1 * 3/2005 Kasper ..... G07F 11/68 83/202
2005/0186010 A1 * 8/2005 Shibata ..... B26F 1/3813 400/621
2007/0158894 A1 * 7/2007 Hasegawa ..... B26D 7/015 270/58.08
2008/0078497 A1 * 4/2008 Bradley ..... B31F 5/06 156/324
2008/0264222 A1 * 10/2008 Dobrescu ..... D05B 27/14 83/437.1
2010/0011931 A1 * 1/2010 Chang ..... B26D 5/083 83/614
2013/0082441 A1 * 4/2013 Banal ..... B65H 9/166 271/272
2013/0276607 A1 * 10/2013 Iida ..... B26D 7/025 83/374
2013/0279963 A1 * 10/2013 Shida ..... B26D 7/015 400/621
2014/0260856 A1 * 9/2014 Chiang ..... B26D 7/32 83/155
2014/0352559 A1 * 12/2014 Matsushima ..... B26D 5/005 101/3.1
2015/0174778 A1 * 6/2015 Baba ..... B26D 7/025 83/452
2015/0183604 A1 * 7/2015 Horaguchi ..... B65H 7/02 271/275
2015/0231901 A1 * 8/2015 Matsushita ..... B26D 7/025 347/110
2015/0273716 A1 * 10/2015 Martin ..... B26D 7/015 83/374
2019/0337093 A1 * 11/2019 Aranda Perez ..... B26F 3/008
2021/0331888 A1 * 10/2021 Lindsey ..... B26D 7/015
2022/0063950 A1 * 3/2022 Tanaka ..... B65H 35/04
2023/0001599 A1 * 1/2023 Crystal ..... B26D 7/20

* cited by examiner

CUTTING PLOTTER

FIELD

The present invention relates to the technical field of cutting apparatus, in particular to a cutting plotter.

BACKGROUND

A cutting plotter is used for plotting a text or graphic, which is designed in a computer, on an object (a sticky note or a plastic film) through a cutting tool which is controlled and driven by the computer after users design to-be-plotted contents by inputting desired characters through graphic-text editing software, matched with the cutting plotter, in the computer, setting a desired font and font size or making a desired picture, and send an instruction to the cutting plotter through the computer.

The cutting plotter is provided with a cutting tool which can move horizontally to plot graphics, required by customers, on paper/plastic films. Existing cutting tools realize horizontal movement through a chain or a rodless cylinder. When a chain-type driving device is installed, a driving wheel, a driven wheel and two sets of tensioning wheels have to be arranged to guarantee the tension of the chain, which leads to a large span of the parallel parts of the chain and a large installation space, thus increasing the overall volume of the cutting plotter and making the cutting plotter inconvenient to use.

SUMMARY

In view of the issues of the prior art, the present invention provides an improved cutting plotter.

In one aspect, the present invention provides a cutting plotter which comprises a cutting plotter shell, a placement plate disposed outside the cutting plotter shell, and an upper transmission assembly and a lower transmission assembly which are disposed at two opposite ends of the cutting plotter shell. The cutting plotter further comprises a belt assembly disposed in the cutting plotter, and the lower transmission assembly and the upper transmission assembly correspond to each other to assist paper in entering the cutting plotter. A slide rod is disposed in the cutting plotter shell and located at a top of the upper transmission assembly, and a cutting tool assembly is disposed around the slide rod. The belt assembly comprises a driving motor, a driving wheel is disposed at an end of an output shaft of the driving motor, the driving wheel is meshed with a driven wheel, a driven belt wheel is disposed on a concentric shaft of the driven wheel, a steering belt wheel is disposed in front of the driven belt wheel, tensioning belt wheels are disposed at two ends of the steering belt wheel, a belt body is disposed around the belt wheels, and the cutting tool assembly is disposed on and driven by the belt body.

In some embodiments, the cutting tool assembly comprises a sliding seat which is sleeved on and slidable along the slide rod, a cutting tool body disposed in an inner side of the sliding seat, and a pressing assembly disposed at a front end of the cutting tool body.

In some embodiments, a semi-circular receiving groove is formed in a position, corresponding to the cutting tool body, of the inner side of the sliding seat.

In some embodiments, the pressing assembly comprises a first pressing member and a second pressing member each of which comprises a wrench and a pressing body formed integrally.

In some embodiments, the first pressing member is connected to an inner side of a front end of the sliding seat through a movable pin, and the second pressing member is connected to an inner side of a prominent portion of the first pressing member through another movable pin.

In some embodiments, return torsion springs are disposed at a joint between the movable pin and the sliding seat, as well as a joint between the another movable pin and the first pressing member.

In some embodiments, the upper transmission assembly comprises an upper rotating shaft, an upper cam is fixedly disposed around the upper rotating shaft. The lower transmission assembly comprises a driving motor, a driving belt wheel is disposed at an end of an output shaft of the driving motor, a transmission belt wheel is disposed at a position, corresponding to the driving belt wheel, of a side of the cutting plotter shell, a transmission belt is disposed between the transmission belt wheel and the driving belt wheel, a lower rotating shaft is disposed on an inner side of the transmission belt, and a lower cam is fixedly disposed around a position, corresponding to the upper cam, of the lower rotating shaft.

In some embodiments, the upper cam and the lower cam rotate in opposite directions when working.

In some embodiments, the upper cam is made of rubber, and an outer circumferential surface of the lower cam is a rough surface.

The present invention has the following beneficial effects:

1. In the cutting plotter of the present invention, a belt assembly is provided and the belt body is steered through the steering belt wheels of the belt assembly, and the distance between parallel parts of the belt body is decreased through the two small-radius tensioning belt wheels, such that the chain installation space is reduced, the volume of the cutting plotter is decreased, and the cutting plotter is more compact and small in overall structure and can be easily used by users.
2. According to the cutting plotter of the present invention, the cutting tool body of the cutting tool assembly is pressed first by the second pressing member and the torsion spring disposed on the second pressing member and is pressed again by the first pressing member which is disposed on the outer side of the second pressing member, such that the cutting tool body is tightly mounted in the sliding seat and can be assembled to the sliding seat and disassembled away from the sliding seat easily.

BRIEF DESCRIPTION OF THE DRAWINGS

The invention will be further described below in conjunction with accompanying drawings and embodiments.

Figure 1:
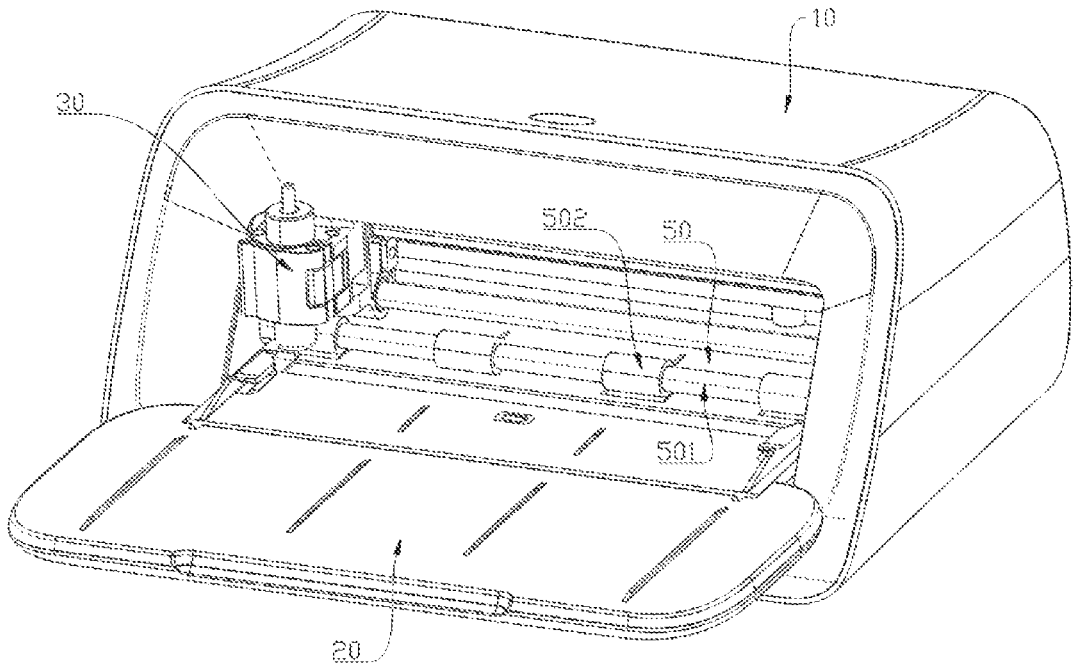
FIG. 1 is a three-dimensional structural view of a cutting plotter.
Figure 2:
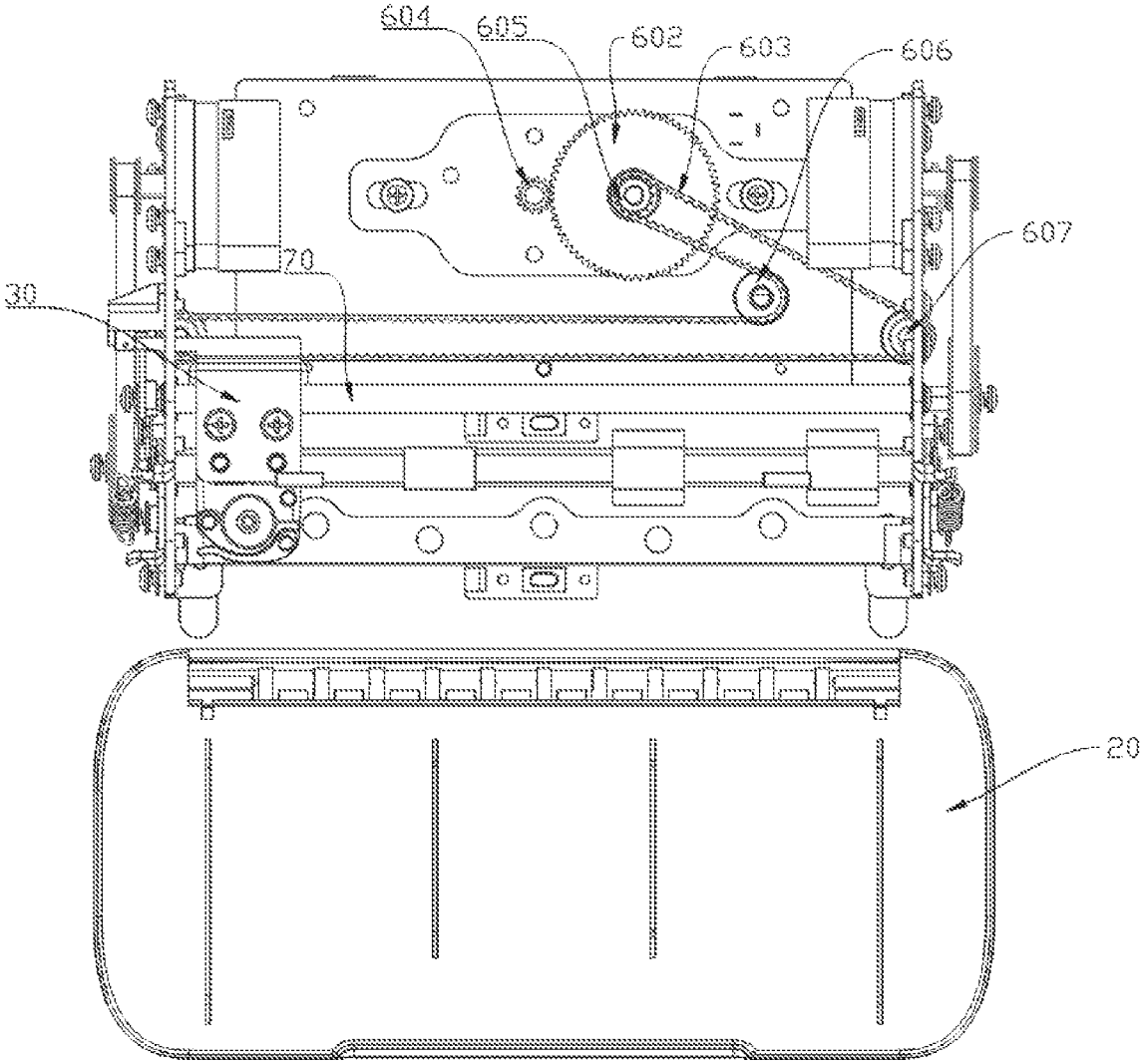
FIG. 2 is a top structural view of a belt assembly of the cutting plotter.

In the figures: 10, cutting plotter shell; 20, placement plate; 30, cutting tool assembly; 40, lower transmission assembly; 50, upper transmission assembly; 60, belt assembly; 70, slide rod;

301, sliding seat; 302, first pressing member; 303, second pressing member; 304, cutting tool body; 305, return torsion spring; 307, receiving groove; 308, pressing assembly 308

401, transmission belt; 402, driving motor; 403, transmission belt; 404, lower cam; 405, lower rotating shaft;

501, upper rotating shaft; 502, upper cam;

601, driving motor; 602, driven wheel; 603, belt body; 604, driving wheel; 605, driven belt wheel; 605, steering belt wheel; 607, tensioning belt wheel.

DESCRIPTION OF THE EMBODIMENTS

To make the technical means, creative features, purposes and effects of the invention easily understood, the invention will be further explained below in conjunction with specific embodiments.

As shown in FIG. 1-FIG. 7, a cutting platter in accordance with an embodiment of the preset invention comprises a cutting plotter shell 10, a placement plate 20 disposed outside the cutting plotter shell 10, an upper transmission assembly 50 and a lower transmission assembly 40 disposed at two ends of the cutting plotter shell 10, and a belt assembly 60. The lower transmission assembly 40 and the upper transmission assembly 50 correspond to each other to assist paper in entering the cutting plotter. A slide rod 70 is disposed in the cutting plotter shell 10 and is located at the top of the upper transmission assembly 50, and a cutting tool assembly 30 is disposed on an outer side of the slide rod 70. The belt assembly 60 comprises a driving motor 601, a driving wheel 604 is disposed at an end of an output shaft of the driving motor 601, one side of the driving wheel 604 is meshed with a driven wheel 602, a driven belt wheel 605 is disposed on a concentric shaft of the driven wheel 602, a steering belt wheel 606 is disposed in front of the driven belt wheel 605, tensioning belt wheels 607 are disposed at two ends of the steering belt wheel 606, a belt body 603 is disposed around the belt wheels 605, 606, 607, and the cutting tool assembly 30 is disposed on an outer side of the belt body 603.

When the cutting plotter is used, a material to be printed is placed on the placement plate 20, and the ends of the material should be placed between the upper transmission assembly 50 and the lower transmission assembly 40. The cutting plotter is started, and the cutting tool assembly 30 of the cutting plotter works according to a desired graphic or text input through graphic-text editing software, matched with the cutting plotter, in the computer. The upper transmission assembly 50 and the lower transmission assembly 40 start to work such that paper between the upper transmission assembly 50 and the lower transmission assembly 40 enters the cutting plotter. The cutting tool assembly 30 moves along with the belt assembly 60; specifically, the driving motor 601 drives the driving wheel 604 to rotate, which in turn drives the driven wheel 602, meshed with the driving wheel 604, to rotate. The driven wheel 602 is movable mounted to the cutting plotter shell 10 through a shaft, and the driven wheel 602 and the driven belt wheel 605 share the same shaft. Thus, the driven belt wheel 605 is rotatable along with the driven wheel 602. The belt body 603 is disposed around the driven belt wheel 605, the steering belt wheel 606 and the tensioning belt wheels 607, so the belt body 603 moves between these belt wheels. The cutting tool assembly 30 is disposed on the belt body 603 and is movably disposed around the slide rod 50, and thus, the cutting tool assembly 30 is movable horizontally along the slide rod 70 to print the graphic or text on the material. Compared with the traditional chain transmission, the chain transmission in this embodiment requires a smaller space and can reduce the overall size of the cutting plotter, such that the cutting plotter is easy to carry and use.

Figure 6:
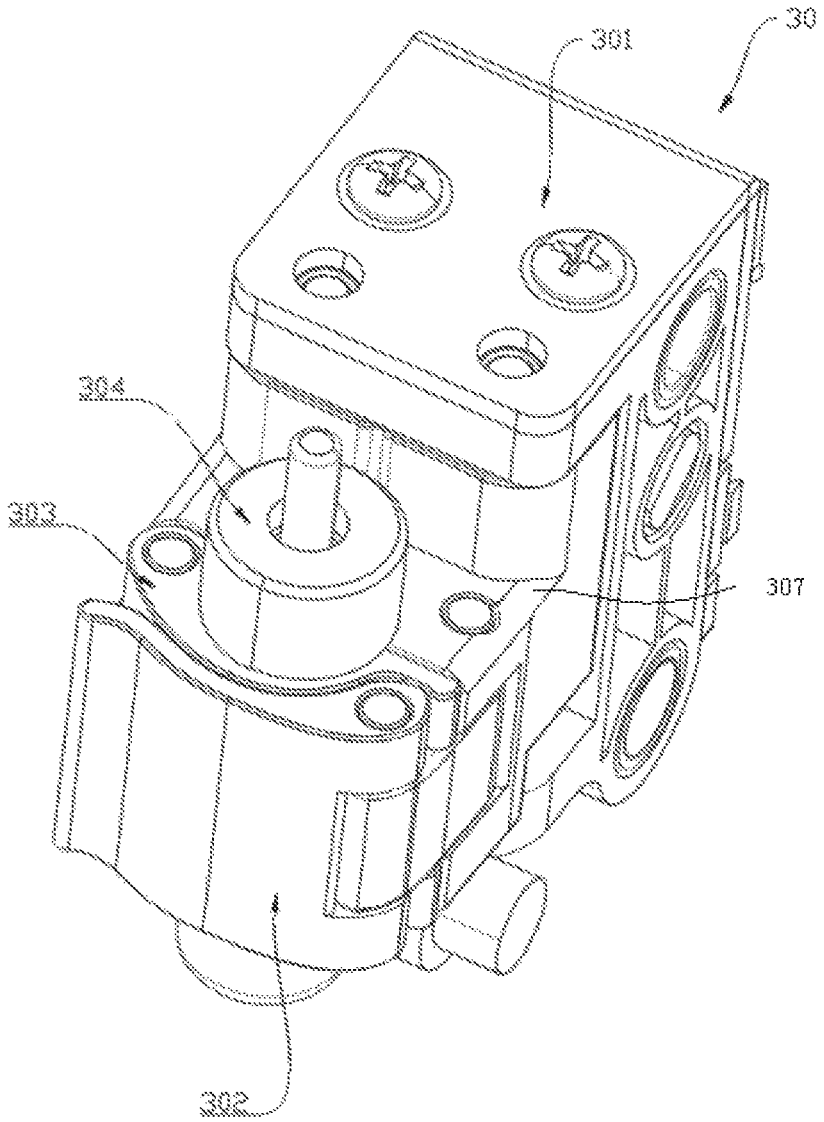
FIG. 6 is an overall structural view of a cutting tool assembly of the cutting plotter.
Figure 7:
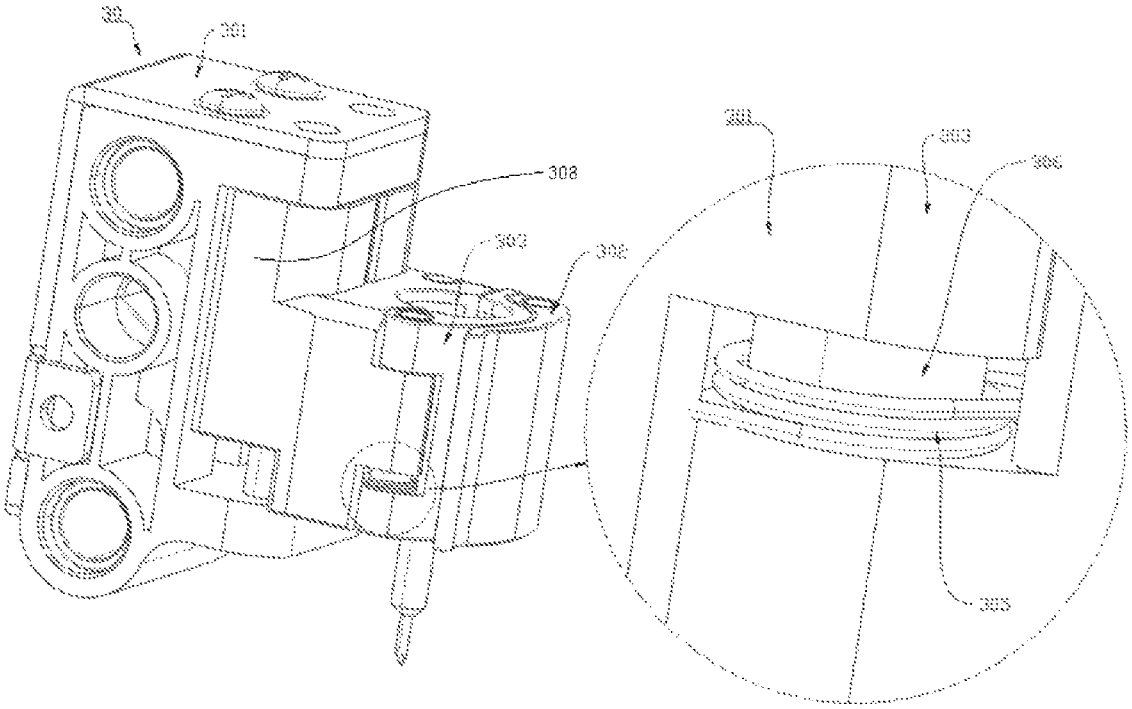
FIG. 7 illustrate the cutting tool assembly of the cutting plotter in another aspect.

Wherein, as shown in FIG. 6, the cutting tool assembly 30 comprises a sliding seat 301 which can slide on the slide rod 70. A cutting tool body 304 is disposed on an inner side of the sliding seat 301, and a pressing assembly 308 is disposed at a front end of the cutting tool body 304; a semi-circular receiving groove 307 is formed in a position, corresponding to the cutting tool body 304, of the inner side of the sliding seat 301. The pressing assembly 308 comprises a pressing member 302 and a second pressing member 303, and the pressing member 302 and the second pressing member 303 are each composed of a wrench and pressing body which are formed integrally. The pressing member 302 is connected to an inner side of a front end of the sliding seat 301 through a movable pin, and the pressing member 303 is connected to an inner side of a prominent portion of the pressing member 302. Return torsion springs 305 are respectively disposed at joints between the movable pins and the sliding seat 301, as well as a joint between the movable pin and pressing member 302. The cutting tool body 304 can be easily assembled on and disassembled from the sliding seat 301 through the pressing member 302 and the pressing member 303. When the cutting tool body 304 needs to be disassembled from the sliding seat 301, the pressing member 302 and the pressing member 303 are opened sequentially, and then, the cutting tool body 304 can be detached from the sliding seat 301. The return torsion springs 305 can apply a torque to the pressing member 302 and the pressing member 303 to press the pressing member 302 and the pressing member 303 against the cutting tool body 304, such that the cutting tool body 304 is prevented from falling off.

Figure 3:
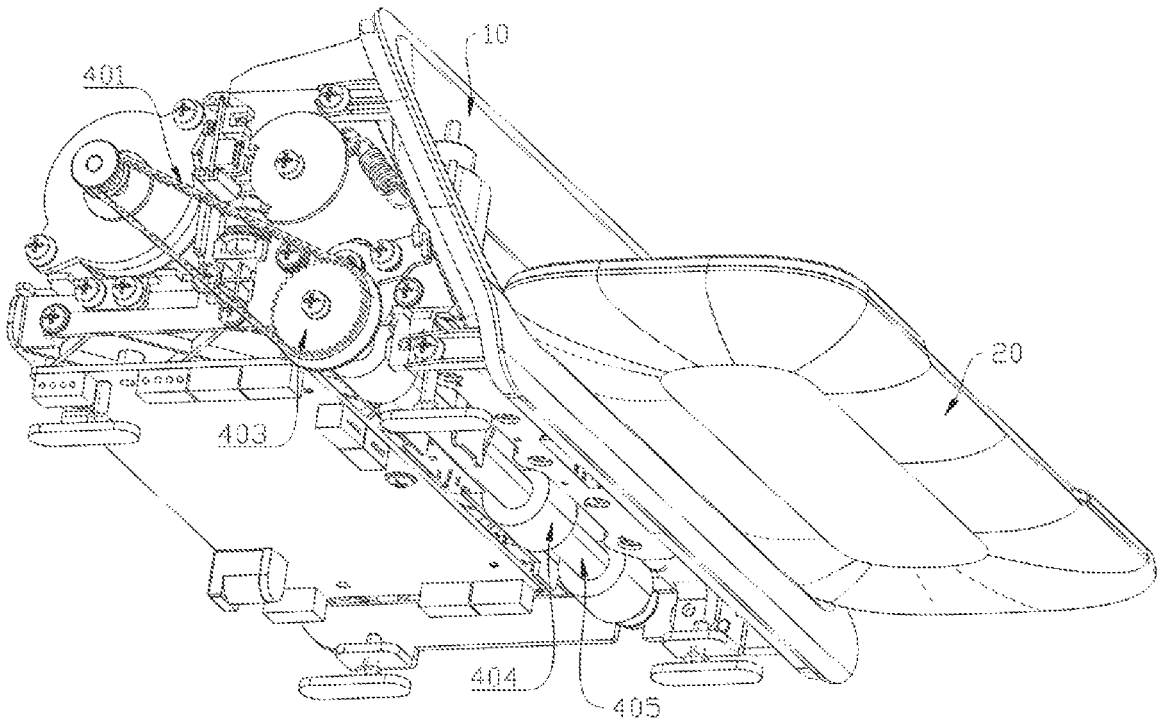
FIG. 3 is an overall structural view of a lower transmission assembly of the cutting plotter.
Figure 4:
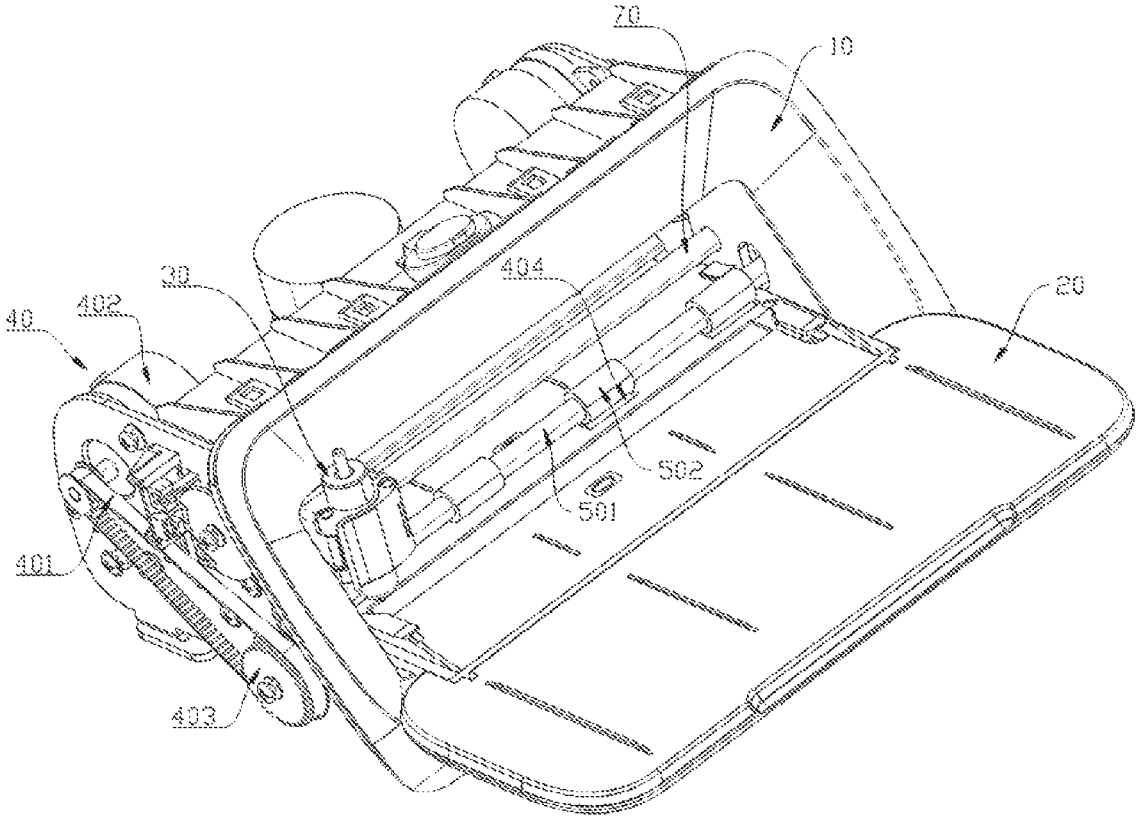
FIG. 4 is an overall structural view of the lower transmission assembly and an upper transmission assembly of the cutting plotter.
Figure 5:
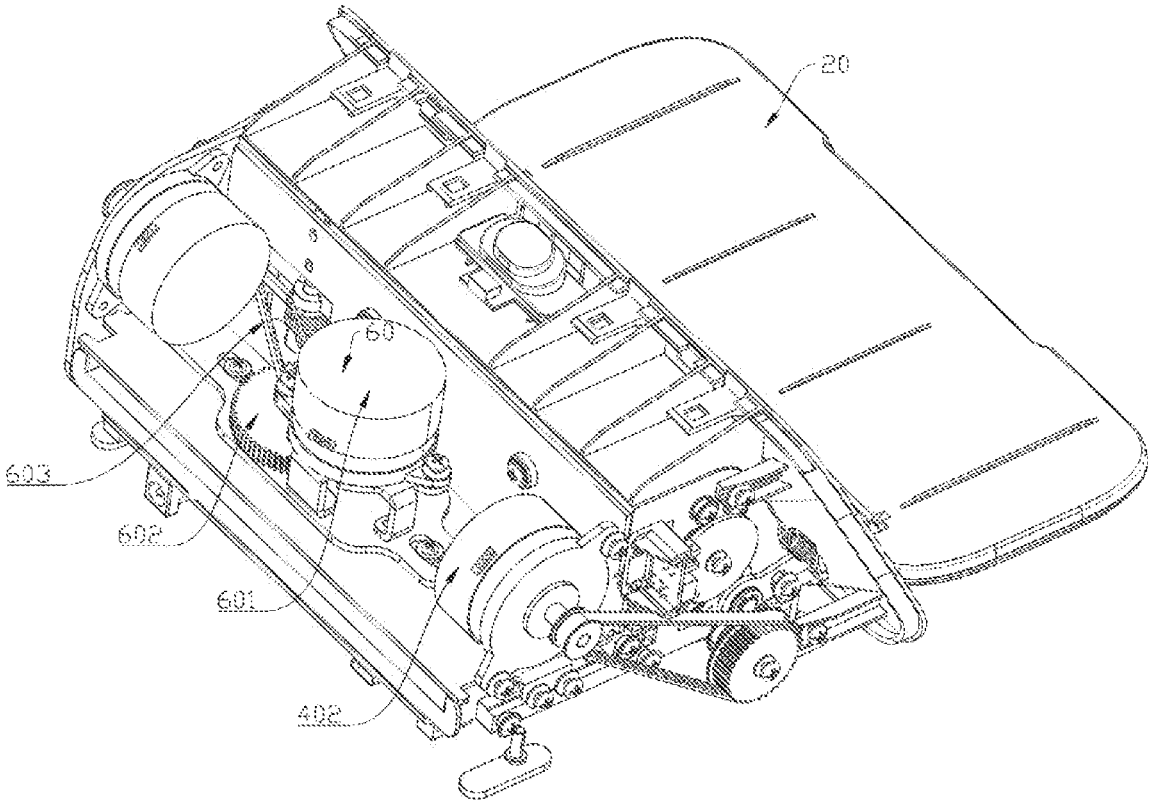
FIG. 5 is a three-dimensional structural view of the belt assembly of the cutting plotter.

Referring to FIG. 1, the upper transmission assembly 50 comprises an upper rotating shaft 501. An upper cam 502 is fixedly disposed around the upper rotating shaft 501. Referring to FIGS. 3-FIG. 5, the lower transmission assembly 40 comprises a driving motor 402, a driving belt wheel is disposed at an end of an output shaft of the driving motor 402, a transmission belt wheel 403 is disposed at a position, corresponding to the driving belt wheel, of one side of the cutting plotter shell 10, a transmission belt 401 is disposed around the transmission belt wheel 403 and the driving belt wheel 401, a lower rotating shaft 405 is disposed on an inner side of the transmission belt 401, and a lower cam 404 is disposed around a position, corresponding to the upper cam 502, of the lower rotating shaft 405.

During the plotting process, paper can be output by means of the upper transmission assembly 50 and the lower transmission assembly 40. Specifically, the driving motor 402 on the lower transmission assembly 40 rotates to drive the driving belt wheel at the end of the output shaft to rotate. The transmission belt 401 is disposed between the driving belt wheel and the transmission belt wheel 402 and thus the transmission belt 401 can transmit rotation of the driving belt wheel to the transmission belt wheel 403 such that the transmission belt wheel 403 can rotate along with the driving belt wheel. The transmission belt wheel 403 is fixedly disposed around the lower rotating shaft 405, and the lower cam 404 is disposed around an outer wall of the lower rotating shaft 405, so the lower cam 404 is driven to rotate. The lower cam 404 indirectly contacts the upper cam 502 through the paper; and under the action of the friction of the paper, the upper cam 502 rotates together with the lower cam 404 to output the paper to the placement plate 20.

Wherein, the upper cam 502 and the lower cam 404 rotate in opposite directions when working; the upper cam 502 is made of rubber, and an outer surface of the lower cam 404 is a rough surface, such that the frictional resistance between paper and the two cams is increased; and the two cams rotate in opposite directions, such that paper or other materials can be output normally.

Working principle: when the cutting plotter is used, paper enters the cutting plotter from an input end of the cutting plotter; then, the driving motor 402 and the driving motor 601 are started, wherein the driving motor 402 drives the driving belt wheel on the output shaft to rotate, and the torque of the driving belt wheel is transmitted, through the transmission belt 401 disposed between the driving belt wheel and the transmission belt wheel 403, to the transmission belt wheel 403 to drive the lower rotating shaft 405 disposed on the inner side of the transmission belt 401 to rotate; the lower cam 404 is disposed around the lower rotating shaft 405 and corresponds to the upper cam 502, and the paper is located between the upper cam 502 and the lower cam 404, and the surfaces of the cams are rough suffices, so the paper is output between the two cams by means of frictional force. The driving motor 601 drives the belt assembly 60 to work, and the driving wheel 604 rotates along with the driving motor 601 to drive the driven wheel 602 to rotate. The driven wheel 602 and the driven belt wheel 605 share the same rotating shaft to cause the driven belt wheel 605 to rotate along with the driven wheel 602. The belt body 603 disposed around the driven belt wheel 605, the steering belt wheel 606 and the two tensioning belt wheels 607 drives the cutting tool assembly 30 disposed on the outer side of the belt body 603 to move to thereby plot a graphic or text on the paper or other materials mainly through the cutting tool body 304 of the cutting tool assembly 30, and the paper plotted with the graphic or text is output to be placed on the placement plate 20.

What is claimed is:

1. A cutting plotter, comprising a cutting plotter shell (10), a placement plate (20) disposed outside the cutting plotter shell (10), and an upper transmission assembly (50) and a lower transmission assembly (40) which are disposed in the cutting plotter shell (10);

wherein the cutting plotter further comprises a belt assembly (60) disposed in the cutting plotter, and the lower transmission assembly (40) and the upper transmission assembly (50) correspond to each other to assist paper in entering the cutting plotter;

a slide rod (70) is disposed in the cutting plotter shell (10) and located at a top of the upper transmission assembly (50), and a cutting tool assembly (30) is disposed around the slide rod (70);

the belt assembly (60) comprises a driving motor (601), a driving wheel (604) is disposed at an end of an output shaft of the driving motor (601), the driving wheel (604) is meshed with a driven wheel (602), a driven belt wheel (605) is disposed on a concentric shaft of the driven wheel (602), a steering belt wheel (606) is disposed in front of the driven belt wheel (605), tensioning belt wheels (607) are disposed at two ends of the steering belt wheel (606), a belt body (603) is disposed around the belt wheels (605, 606, 607), and the cutting tool assembly (30) is disposed on and driven by the belt body (603);

the cutting tool assembly (30) comprises a sliding seat (301) which is sleeved on and slidable along the slide rod (70), a cutting tool body (304) disposed in an inner side of the sliding seat (301), and a pressing assembly (308) disposed at an end of the cutting tool body (304); and a semi-circular receiving groove (307) is formed in a position, corresponding to the cutting tool body (304), of the inner side of the sliding seat (301).

2. The cutting plotter according to claim 1, wherein the pressing assembly comprises a first pressing member (302) and a second pressing member (303) each of which comprises a wrench and a pressing body formed integrally.

3. The cutting plotter according to claim 2, wherein the first pressing member (302) is connected to an inner side of a front end of the sliding seat (301) through a movable pin, and the second pressing member (303) is connected to an inner side of a prominent portion of the first pressing member (302) through another movable pin.

4. The cutting plotter according to claim 3, wherein return torsion springs (305) are disposed at a joint between the movable pin and the sliding seat (301), as well as a joint between the another movable pin and the first pressing member (302).

5. The cutting plotter according to claim 1, wherein the upper transmission assembly (50) comprises an upper rotating shaft (501), an upper cam (502) is fixedly disposed around the upper rotating shaft (501);

the lower transmission assembly (40) comprises another driving motor (402), a driving belt wheel is disposed at an end of an output shaft of the another driving motor (402), a transmission belt wheel (403) is disposed at a position, corresponding to the driving belt wheel, of a side of the cutting plotter shell (10), a transmission belt (401) is disposed between the transmission belt wheel (403) and the driving belt wheel, a lower rotating shaft (405) is disposed on an inner side of the transmission belt (401), and a lower cam (404) is fixedly disposed around a position, corresponding to the upper cam (502), of the lower rotating shaft (405).

6. The cutting plotter according to claim 5, wherein the upper cam (502) and the lower cam (404) rotate in opposite directions when working.

7. The cutting plotter according to claim 5, wherein the upper cam (502) is made of rubber, and an outer circumferential surface of the lower cam (404) is a rough surface.

8. A cutting plotter, comprising a cutting plotter shell (10), a placement plate (20) disposed outside the cutting plotter shell (10), and an upper transmission assembly (50) and a lower transmission assembly (40) which are disposed in the cutting plotter shell (10);

wherein the cutting plotter further comprises a belt assembly (60) disposed in the cutting plotter, and the lower transmission assembly (40) and the upper transmission assembly (50) correspond to each other to assist paper in entering the cutting plotter;

a slide rod (70) is disposed in the cutting plotter shell (10) and located at a top of the upper transmission assembly (50), and a cutting tool assembly (30) is disposed around the slide rod (70);

the belt assembly (60) comprises a driving motor (601), a driving wheel (604) is disposed at an end of an output shaft of the driving motor (601), the driving wheel (604) is meshed with a driven wheel (602), a driven belt wheel (605) is disposed on a concentric shaft of the driven wheel (602), a steering belt wheel (606) is disposed in front of the driven belt wheel (605), tensioning belt wheels (607) are disposed at two ends of the steering belt wheel (606), a belt body (603) is disposed around the belt wheels (605, 606, 607), and the cutting tool assembly (30) is disposed on and driven by the belt body (603);

the cutting tool assembly (30) comprises a sliding seat (301) which is sleeved on and slidable along the slide rod (70), a cutting tool body (304) disposed in an inner side of the sliding seat (301), and a pressing assembly (308) disposed at an end of the cutting tool body (304); and the pressing assembly comprises a first pressing member (302) and a second pressing member (303) each of which comprises a wrench and a pressing body formed integrally.

9. The cutting plotter according to claim 8, wherein the first pressing member (302) is connected to an inner side of a front end of the sliding seat (301) through a movable pin, and the second pressing member (303) is connected to an inner side of a prominent portion of the first pressing member (302) through another movable pin.

10. The cutting plotter according to claim 9, wherein return torsion springs (305) are disposed at a joint between the movable pin and the sliding seat (301), as well as a joint between the another movable pin and the first pressing member (302).

* * * * *